US009815172B2

(12) United States Patent
Quan et al.

(10) Patent No.: US 9,815,172 B2
(45) Date of Patent: Nov. 14, 2017

(54) METHOD OF STEEL SHEET SURFACE TREATMENT AND APPARATUS OF THE SAME

(71) Applicant: BAOSHAN IRON & STEEL CO., LTD., Shanghai (CN)

(72) Inventors: Jizhe Quan, Shanghai (CN); Shanqing Li, Shanghai (CN); Mingnan Duan, Shanghai (CN); Yingjie Wang, Shanghai (CN); Jianghua Xu, Shanghai (CN); Peilei Qu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 119 days.

(21) Appl. No.: 14/649,675

(22) PCT Filed: Mar. 5, 2014

(86) PCT No.: PCT/CN2014/072895
§ 371 (c)(1),
(2) Date: Jun. 4, 2015

(87) PCT Pub. No.: WO2014/146540
PCT Pub. Date: Sep. 25, 2014

(65) Prior Publication Data

US 2016/0008950 A1 Jan. 14, 2016

(30) Foreign Application Priority Data

Mar. 19, 2013 (CN) ..... 2013 1 0088713

(51) Int. Cl.

| | |
|---|---|
| ***B24C 1/00*** | (2006.01) |
| ***B21B 45/02*** | (2006.01) |
| ***B21B 45/08*** | (2006.01) |

(52) U.S. Cl.
CPC ..... *B24C 1/00* (2013.01); *B21B 45/0269* (2013.01); *B21B 45/08* (2013.01); *B21B 45/0284* (2013.01); *B21B 45/0287* (2013.01)

(58) Field of Classification Search
CPC ... B24C 1/00; B21B 45/0264; B21B 45/0284; B21B 45/0287; B21B 45/08
(Continued)

(56) References Cited

U.S. PATENT DOCUMENTS 3,447,756 A * 6/1969 Lawrence, Jr. ..... B05B 1/044 239/568
5,283,991 A * 2/1994 Keizers ..... B24C 7/0015 451/101
(Continued)

FOREIGN PATENT DOCUMENTS

CN 102357541 A 2/2012
CN 102847631 A 1/2013
(Continued)

OTHER PUBLICATIONS

PCT International Search Report, PCT/CN2014/072895, dated May 19, 2014, 4 pages.

*Primary Examiner* — George Nguyen
(74) *Attorney, Agent, or Firm* — Quarles & Brady LLP

(57) ABSTRACT

The present invention relates to a method of steel sheet surface treatment, wherein, the method comprises sequentially: a strip surface treatment unit (1) configured with a high pressure spraying device (1-1) or a centrifugal ejecting device (1-2), a strip surface rinsing unit (2), and a strip surface dry unit (3). Either or both of the high pressure spraying devices (1-1) and the centrifugal ejecting devices (1-2) are arranged, and spray onto the strip surfaces with a mixture of solid abrasives and water, i.e., slurry. Additionally, the method of steel sheet surface treatment comprises: a slurry supplying unit (4) and an abrasive recycling unit (5).
(Continued)

When the method of the present invention is applied into the strip post processing line, it can control the surface roughness of the steel sheet, while clearing away grease, scales and some contaminations thereon, through impacting the mixture of water and solid particles with a certain ratio onto the surfaces of the strip steel. When the method of the present invention is applied into the finishing processing line, it can control the surface roughness of the steel sheet, while adjusting the mechanical properties of the strip, thereby completely or partially replacing the skin pass process.

9 Claims, 4 Drawing Sheets

(58) Field of Classification Search
USPC ..... 451/36–40, 75, 87
See application file for complete search history.

(56) References Cited

U.S. PATENT DOCUMENTS 6,203,403 B1 * 3/2001 Odstrcil ..... B24B 29/02 451/28
6,436,205 B1 * 8/2002 Behrens ..... B21B 1/46 148/508
6,582,586 B1 * 6/2003 Akashi ..... C25F 7/00 148/574
7,077,724 B1 * 7/2006 Voges ..... B21B 45/08 134/15
2011/0130075 A1 * 6/2011 Voges ..... B24C 1/086 451/38
2013/0084785 A1 * 4/2013 Cho ..... B21B 45/06 451/75
2013/0267152 A1 * 10/2013 Tera ..... B24C 1/045 451/99

FOREIGN PATENT DOCUMENTS

| | | | |
|---|---|---|---|
| CN | 102847731 | A | 1/2013 |
| JP | S60161559 | U | 10/1985 |
| JP | 3022273 | B2 | 3/2000 |
| JP | 2002285237 | A | 10/2002 |
| JP | 2003305647 | A | 10/2003 |
| JP | 2005118902 | A | 5/2005 |
| JP | 2010503544 | A | 2/2010 |
| JP | 2012522654 | A | 9/2012 |
| KR | 1020110134711 | | 12/2011 |
| WO | 2008033660 | A2 | 3/2008 |
| WO | 2010117529 | A1 | 10/2010 |

* cited by examiner

METHOD OF STEEL SHEET SURFACE TREATMENT AND APPARATUS OF THE SAME

CROSS-REFERENCE TO RELATED APPLICATIONS

This application represents the national stage entry of PCT International Application No. PCT/CN2014/072895 filed Mar. 5, 2014, which claims priority of Chinese Patent Application No. 201310088713.3 filed Mar. 19, 2013, the disclosures of which are incorporated by reference here in their entirety for all purposes.

TECHNICAL FIELD

The present invention belongs to the field of post processing line for cold rolled steel sheet, and particularly, it relates to a method of steel sheet surface treatment and an apparatus of the same. Through impacting the mixture of water and solid particles with a certain ratio onto the surfaces of the strip steel by a high pressure spraying device or centrifugal ejecting device, the method of steel sheet surface treatment and the apparatus of the same, on the one hand, clears away grease, scales and some contaminations thereon while imparts a certain roughness on the surfaces of the steel sheet; on the other hand, adjusts the mechanical properties of the strip by way of impacting the surface thereof, thereby completely or partially replacing the skin pass process.

BACKGROUND

After being rolled to a certain thickness by a cold rolling machine, the strip steel, depending upon the demands of products, will be transferred into some different post-processing processes, for instance, hot dip galvanized products need to be transferred into the continuous galvanizing units, electrogalvanized products need to be transferred into continuous electrogalvanizing units after continuous annealing, and the common cold products forms cold rolled products through the continuous annealing process or the batch annealing process. For the strip steel coating process such as the continuous hot dip galvanizing or the electrogalvanizing process, the surface condition and the cleanliness of the strip is the prerequisite to ensure the quality of the continuous annealed coatings. However, during rolling the strip, it is difficult to prevent various foreign materials, such as dregs in the rolling oil, residual iron powder in cold rolling, accumulating dust, weld slag produced in head welding or the like, from remaining on the surfaces thereof.

Consequently, the strip has to be cleaned so as to remove thoroughly the oil contaminations on its surface before continuous annealing. Otherwise, a variety of oils remaining on the surfaces would form carbonaceous blotches during annealing, which will contaminate the atmosphere inside the furnace, affect the efficiency of decarburization, and even cause recarburization. Additionally, the oil contaminations may change the quality of the strip surfaces and induce nodulation on the bottom rollers, thereby resulting in defects such as surface scratches thereof, or the like.

In light of this, a rinsing process is provided on the continuous coating units before annealing, which process is also referred to as degreasing process, with the aim of removing the variety of foreign materials residual on the strip surfaces.

For the continuous annealing process after which cold rolled products are directly formed, the surface cleanliness of the incoming strips determines directly the surface quality of the final products. In view of this, surface pre-treatment processes such as alkaline washing, brush washing, electrolysis washing, hot water rinsing or the like, are provided on the entry section of the continuous annealing processing line, so as to ensure the surface quality of the strips entering there. Similarly, in the batch annealing process, specific degreasing devices are disposed before the batch annealing processing line, so as to guarantee the surface quality of the strips entering there.

However, in the practical manufacturing process, there are always such phenomena that dirty matters on the strip surfaces that cannot be cleared away, causing spots, stripes, uneven coats to occur on the surfaces after the strips are subjected to annealing or coating, so that the surface quality of the products would be influenced. To overcome these, the skilled in the site provide many adjustments and optimization on the aspects of the processes, such as alkaline spraying process, brush washing process, degreasers, lye concentration, and temperature. Nevertheless, owing to the variety and complexity of the dirty matters, such as the difference in components between different strips, the inconformity of the bonding force between the matters and the strips, and the rapid running of the strips, the dirty matters on the strip surfaces cannot yet be cleared away thorough during manufacturing.

Additionally, to meet the requirements for the roughness and the following coating process by customers, it is necessary for the surfaces of the cold rolled strip to be of a certain roughness, but due to the limitations on the rolling process and the rollers, the roughness thereof cannot meet the requirements often. Especially when manufacturing the high-strength steels with high intensity, the surface roughness thereof cannot reach the standard, even if the roughness controlling ability of the roll machine reaches to the extremity.

In light of this, it is necessary to control the roughness of the strips during the procedures following the cold rolling process, wherein only the skin-pass mill can control the surface roughness of the strips. However, there are a lot of problems with the roughness control during the skin pass process, for instance, 1) during the skin pass process, the roughness of the work rollers have the maximum effect on the surface roughness of the strip. The work rollers should be treated prior to working, by laser texturing, electric spark texturing, shot blasting or the like, so as to impart the surface of the work rollers a certain roughness. In the beginning of the period when the work roller work, the surface roughness of the roller surfaces is the key factors to determine the surface roughness of the strips. Nevertheless, with the increase of the rolling mileages, the surface roughness of the roller decreases, causing the surface roughness of the strip to be unable to meet the requirement of the customer;

2) during the skin pass process, due to that controlling the surface roughness of the rollers is the only method of controlling the roughness of the strips, when the roughness of finished products are found not meeting the requirement, the only way is to replace the rollers, whereby the roughness thereof cannot be flexibly controlled.

3) with the increase on the requirement of the high strength steels, the strength of the strip becomes higher, and if the strength thereof reaches a certain level, the requirements of customers may not be met by the skin-pass mill, even when the rollers just begin to work.

Consequently, it is badly in need to develop processes and equipments for controlling the surface roughness of the strips.

Aiming to the problems on the pre-treatment and roughness of the rolled strip surfaces, a large amount of researches have been carried out in and out of the country. For instance, a high density current degreasing technique is developed abroad for the pre-treatment on the surface of the strips, the principle of which is to take alkaline degreasing liquid as the conduct medium to form a high density of current of about 200 A/d $m^2$ on the strip surfaces, such that a large amount of bubbles are generated in an instant on the strip surfaces to blast the layer of the oil contaminations thereon, thereby cleaning the strips. Although this technique can be adapted to the rapid manufacturing, it would consume the electric energy as 10 times as the traditional processes, and its production cost is very high; additionally, due to it is of high precision, the maintenance cost thereof is also very high. The China patent CN102357541A discloses a method of washing the strip surface with hot water circulation, and a system thereof. Its principle is that before the strips are subjected to alkaline brush washing, hot water with a high pressure of 8~12 MPa and a temperature of 40~70° C., is used to spray onto the upper and lower surfaces of the strip, so as to reduce the number of the combination equipments and the energy consumption during the subsequent alkaline brush washing and electrolysis procedures. This method acts as an improved one of the traditional degreasing process. The way of spraying hot water can wash away those foreign materials weakly bonding to the strip surface, but cannot clear thoroughly those tightly bonding to the strips and those recessed in the dent layers thereof. China patent CN201217016 Y discloses an ultrasonic treatment device for washing the strip surface, the principle of which is to combine the strip surface washing process with the ultrasonic treatment, and additionally install a ultrasonic wave generation device into the strip alkaline washing (pickling) or electrolysis alkaline washing (pickling) sink, so as to wash and clean the strip surfaces. This method also acts as an improved one of the traditional degreasing process, which improves the flow of alkaline liquid, that is, has an obvious effect on removing the oil film of the strip surface, but cannot yet clear away thoroughly the foreign materials bonding tightly to the strips. China patent CN101537431A introduces a method of online predicting and controlling the surface roughness of thin strips, which is characterized in that the roughness values in different length of the strips are calculated by the roughness data of the work rollers of the skin-pass mill, the length of the strip, the rolling force in different lengths of strips, and the elongation rate thereof, and when the target value of the roughness of the strip does not fall into the predicted scopes, the roughness is predicted and controlled by adjusting the rolling force and the elongation rate. This method can only reduce the roughness errors of the strip, but unable to solve the problem that the roughness cannot reach the standard in the traditional process. The patent CN1804739A introduces a technology for predicting and controlling the surface roughness of finished plate for skin-pass mill, the principle of which goes similarly to the above-mentioned patent, that is, to predict and control the surface roughness of strip by building a mathematic model between the roller roughness and rolling kilograms, and a mathematic relationship between the reduction rate and heritability, and by building a model of skin-pass mill online predicting finished products roughness according to the site data. Similarly, this method can only reduce the roughness errors of the strips, but unable solve the problem that the roughness cannot reach the standard in the traditional process.

The patent CN101675184A discloses a steel sheet rinsing method for rinsing a running steel sheet, and a steel sheet continuous rinsing apparatus, the principle of which is to supply the ultrasonic washing liquid with a frequency of 0.8 MHz~3 MHz to the steel sheet surface inclined by an angle of 1~80° relative to a line perpendicular to the steel sheet surface along a direction opposite to the running direction of the steel sheet in a spraying manner or a curtain manner, whereby the high frequency ultrasonic wave is utilized for rinsing the surfaces of the running steel sheets, and the rinsing effect and the rinsing speed is improved. This method adopts the cavitation occurring on the steel sheet to intensify the chemical reaction of the rinsing, and provide the impact force, thereby enhancing the rinsing effect, but it is yet unable to clear away the foreign materials bonding tightly to the strip. Aiming to control of the surface roughness of the strip, the patent CN1622869A owned to a Japanese applicant introduces a surface treatment facility of metal plate and a method for producing metal plate, which features in that the surface roughness of the steel sheet is controlled by blasting solid particles having an average particle diameter 300 μm onto the metal plate which is continuously transferred. The present invention consists mainly of a blasting chamber in which a blasting device is disposed, and cleaning means provided at the downstream of the blasting chamber for cleaning the surface of the metal sheet. Specifically, a metal plate enters the blasting chamber wherein the blasting device impacts the dry solid particles onto the surface thereof, and the cleaning chamber at the downstream of the blasting chamber rinses the solid particles on the surface of the metal plate by means of air nozzles. In this invention, the medium for impacting the strip surfaces is dry solid particles, which may result in that the metal plate entering the blasting chamber is required to be dry for keeping the mobility of the solid particles. Consequently, it is necessary to provide devices for rinsing and drying the steel sheet on the blasting chamber, which may lead to complicated units. Additionally, during the whole blasting and rinsing process, no liquid should be accessible to the units, which is a high requirement on sealing the devices and the like, that is difficult to meet in actual production. Furthermore, the solid particles are impacted directly onto the surface of the metal plate, and owing to that the particle size of the solid particles are larger than that of the metal plate, the solid particles are apt to embedding into the metal plate surface and hence the solid particles on the strip surfaces cannot be cleared away thoroughly by spraying air in this invention.

SUMMARY

To overcome the aforementioned problems, the present invention provides an innovative process that can treat the surfaces of the cold rolled steel sheet.

To overcome the aforementioned problems, the present invention provides an innovative device that can treat the surfaces of the cold rolled steel sheet. The process and the device impact a mixture of water and solid abrasives with a certain ratio onto the surfaces of the steel sheet by a high pressure abrasive spraying device, so as to render a certain roughness to the surfaces of the steel sheet, and to clear away the grease, scales and some dirty matters remaining thereon.

The present invention, on the one hand, can flexibly control the surface roughness of the rolled steel sheet, and especially impart the required roughness by the customer to the high strength steel with high intensity, thereby solving the problem that the surface roughness of the strips cannot reach the standard because of the limitations on the rolling processes and the materials of the rollers when manufacturing high strength steels; at the same time, on the other hand, the present invention, by the method of spraying mixed abrasives onto the steel sheet surfaces, removes the grease, scales and some dirty matters remaining thereon, thereby reducing the loads and equipment length of the surface pre-treatment sections, and improving the cleanliness thereof.

Additionally, the device and process of the present invention are provided on the finishing process, and adjust the mechanical properties of the strips by impacting the mixture of solid abrasives and water onto the strip surfaces, thereby completely or partially replacing the skin-pass mill.

When the steel sheet surface treatment method of the present invention is provided on the entry sections of the production lines of continuous hot dip galvanizing, continuous electrogalvanizing, continuous annealing and continuous degreasing, it controls flexibly the surface roughness of the strips online by impacting the mixed solid abrasives onto the strip surfaces, and meanwhile clears away the contaminations like grease, scales remaining thereon, so as to treat the same. When the steel sheet surface treatment method of the present invention is provided on the finishing treatment line, it controls the surface roughness of the strips by impacting the mixed solid abrasives onto the strip surfaces, and meanwhile improves the mechanical properties of the strip, thereby completely or partially replacing the skin-pass mill.

The technical solution of the present invention is as follows:

A method of steel sheet surface treatment, wherein, the method comprises sequentially:

a strip surface treatment unit 1 configured with a high pressure spraying device 1-1 or a centrifugal ejecting device 1-2, either or both of the high pressure spraying device 1-1 and the centrifugal ejecting device 1-2 may be arranged, the high pressure spraying device 1-1 or the a centrifugal ejecting device 1-2 sprays onto the strip surface with the mixture of solid abrasives and water, i.e., slurry, a strip surface rinsing unit 2, a strip surface dry unit 3, additionally, the method of steel sheet surface treatment comprises:

a slurry supplying unit 4, which supplies slurry to the steel sheet surface treatment unit 1 configured with the high pressure spraying device 1-1 or the centrifugal ejecting device 1-2, and an abrasive recycling unit 5.

Refer to FIGS. 3 to 9 wherein the devices of the present invention are applied onto the actual production lines.

When the present invention is applied to the entry section of the post treatment production line of the cold rolled strip, the detailed implementation is described as follows. The cold rolled strip enters the steel sheet surface treatment device 1 when a variety of dirty matters remain on the strip surfaces, including rolling oil and oil dreg therein, iron powder generated in the rolling process, accumulating dust, weld slag generated in welding, or the like. Those dirty matters have to be cleared thoroughly so as to meet the requirements on the surface quality by the subsequent procedures and the products. Besides, the surface roughness of the rolled strip cannot yet meet the requirement of the customers. A plurality of groups of high pressure spraying devices 1-1 or centrifugal ejecting devices 1-2 are provided along the running direction of the strip and/or along the direction of the width direction thereof in the strip surface treatment device, according to the speed of the product line and the demand of the products. The mixture of solid abrasives and water is sprayed onto the strip surface evenly from the high pressure spraying devices 1-1 or the centrifugal ejecting devices 1-2, then the dirty matters adhered to the strip surfaces are separated from the strips under the impact effects of the solid abrasives and water, and brought away by the water, whereby the objective of clearing the dirty matters on the strip surfaces are achieved. Besides, due to that the solid particles impacting on the strip surfaces, have a certain speed and energy, and the hardness of the solid particles is larger than that of the strip, such that when the solid particles impact onto the strip surfaces, plastic and elastic deformation take places on the strip surface, and after the solid particles pop out, a series of tiny dents with random arrangement, are formed on the surfaces thereof, so as to achieve the objective of controlling the surface roughness of the strip. The surface roughness of the strip depends on the factors such as the movement velocity of the strip, the speed and the energy of the solid particles impacting on the strip surfaces, which can be configured flexibly according to the specific requirements on products. The strip treated like this, has no or few dirty matters on its surfaces, and the surface roughness thereof can meet the requirement of the subsequent procedures. The sprayed mixture of abrasives and water stacks beneath the strip surface treatment unit 1, and after being treated by the abrasive recycling device 5, it would transfer circularly into the abrasive supplying device 4. Accordingly, a certain amount of abrasives may remain on the strip treated by the strip surface treatment device 1, and be cleared away by the surface rinsing unit 2 provided at the downstream of the strip surface treatment unit 1. The surface rinsing unit 2 uses pure water with a certain pressure to rinse the strip surfaces. The rinsed strip has no solid particle remained on its surface, and after being dried in the strip surface dry unit 3, enters the subsequent procedure.

When the present invention is applied to the finishing section of the post treatment production line of the cold rolled strip, the detailed implementation is described as follows. The strip subjected to heat treatment or surface coated enters the steel sheet surface treatment section wherein the surface roughness of the rolled strip cannot yet meet the requirement of the customers. The strip 6 enters the strip surface treatment unit 1, wherein according to the speed of the product line and the demand of the products, a plurality of groups of high pressure spraying devices 1-1 or centrifugal ejecting devices 1-2 are provided along the running direction of the strip and/or along the width direction thereof. The mixture of solid abrasives and water are sprayed evenly onto the strip surface from the high pressure spraying devices 1-1 or the centrifugal ejecting devices 1-2. Under the impact effects of the solid abrasives and water, a series of tiny dents are formed on the surfaces thereof, so as to achieve the objective of controlling the surface roughness of the strip. Additionally, aiming to the annealed strips, when the impact energy and speed of the slurry reaches a certain level, under the impact effects of the slurry, the mechanical properties of the strip changes, and the yield platform vanishes, so as to meet the requirements of the processes such as stamping, thereby completely or partially replacing the skin pass procedure.

The steel sheet surface treatment method according to the present invention, wherein the mixture of solid particles and water for impacting the strip surfaces has a mixture ratio of 10~95%, and the solid abrasives may be selected from iron sand, steel shots, cut wire shots or the like, and the particle sizes of the solid particles are between 20 and 100 meshes, preferably between 60 and 80 meshes.

The steel sheet surface treatment method according to the present invention, wherein the mixture of solid particles and water for impacting the strip surfaces has a mixture ratio of 10~30%.

The strip surface treatment unit 1 in the present invention is provided with a plurality of groups of high pressure spraying devices 1-1 or centrifugal ejecting devices 1-2, wherein the high pressure spraying devices 1-1 use high pressure water of a certain pressure to bring solid particles to impact the strip surfaces, while the centrifugal ejecting devices 1-2 use blades to swing out the slurry with a certain mixture ratio in a high speed to impact the strip surfaces, each group of the high pressure spraying devices 1-1 and the centrifugal ejecting devices 1-2 can be set at different impact energy and speed.

In the present invention, the spraying velocity or energy of the high pressure spraying devices 1-1 or the centrifugal ejecting devices 1-2 and the mixture ratio of the spraying slurry, the particle size of the abrasives, etc. depend on the factors such as the strength of the strip to be treated, the operation speed of the units and the roughness required by customers.

The steel sheet surface treatment method according to the present invention, wherein, 5~30 groups of high pressure spraying devices are arranged along the width of the steel sheet in the strip surface treatment unit 1 in the present invention, and each group of spraying device may cover 50~100 mm of a width of the strip which is 700~1400 mm.

Furthermore, preferably, 2~8 rows of high pressure spraying devices 1-1 may be arranged along the running direction of the strip. This number may be increased or decreased depending upon the operation speed of the units. For the centrifugal ejecting devices 1-2, 1 to 2 groups of the centrifugal ejecting devices 1-2 are arranged along the width of the steel sheet, and cover the spraying of the whole width of the steel sheet by adjusting the ejecting angle. Similarly, 2~8 groups of centrifugal ejecting devices 1-2 are also arranged along the running direction of the strip.

The steel sheet surface treatment method according to the present invention, wherein the strip surface treatment unit 1 of the present invention may be provided with either or both of high pressure spraying devices 1-1 and centrifugal ejecting devices 1-2, and the centrifugal ejecting devices 1-2 are preferably used for spraying onto the central portion of the strip while the high pressure spraying devices 1-1 are preferably used for spraying onto the edge portions of the strip.

The steel sheet surface treatment method according to the present invention, wherein the surface roughness of the strip is controlled between 0.5 μm and 5 μm.

The steel sheet surface treatment method according to the present invention, wherein the slurry supplying device 4 may supply slurry with abrasives of different solid particle sizes and mixture ratios, to each group of the high pressure spraying devices 1-1 or centrifugal ejecting devices 1-2.

The steel sheet surface treatment method according to the present invention, wherein a filter recycling device 5 is used for recycling the solid abrasives.

The steel sheet surface treatment method according to the present invention, wherein the strip surface treatment unit 2 rinses the strip surfaces with pure water of a pressure 5~30 MPa, and the strip surface dry unit 3 dries the strip surface with hot wind.

The steel sheet surface treatment method according to the present invention, wherein the speed of the solid abrasives and water impacting onto the strip surface is in the range of 30 m/s~300 m/s.

The steel sheet surface treatment method according to the present invention, wherein the speed of the solid abrasives and water impacting onto the strip surface is in the range of 40 m/s~80 m/s.

The steel sheet surface treatment method according to the present invention, wherein the present invention may be performed in separate degreasing units.

The devices for pre-cleaning, brush washing, electrolytic cleaning, rinsing in the original units, may be replaced, as shown in FIG. 3.

The steel sheet surface treatment method according to the present invention, wherein the present invention may be performed before the annealing furnace and entry loop of the continuous annealing units.

Thus, the devices for alkaline cleaning, brush washing, electrolytic cleaning, hot water rinsing in the traditional continuous annealing process, may be replaced, as shown in FIG. 4.

The steel sheet surface treatment method according to the present invention, wherein the present invention may be performed before the annealing furnace of the hot dip galvanizing units.

Thus, the rinsing process in the traditional hot dip galvanizing process may be replaced, as shown in FIG. 5.

The steel sheet surface treatment method according to the present invention, wherein the present invention may be performed before the electrogalvanizing sink after the entry loop of the electrogalvanizing units.

Thus, the processes such as degreasing, pickling in the traditional electrogalvanizing process, may be replaced, as shown in FIG. 6.

The present invention may be performed at the downstream of the skin-pass units.

Thus, when the surface roughness of the skin-passed strip cannot meet the requirement of the customers, it acts as a roughness controlling process to control the surface roughness of the steel sheet precisely, which is especially suitable for the case in which the strip is of high strength and the requirements on the surface roughness by customers cannot be met by the skin pass process, as shown in FIG. 7.

Moreover, according to the present invention, the present invention can be arranged at the downstream of the skin pass process of the finishing procedure with the continuous annealing units and skin pass units, so as to control the surface roughness of the strip precisely, wherein the annealing units comprise processes such as hot dip galvanizing, electrogalvanizing, continuous annealing, as shown in FIG. 8.

Moreover, according to the present invention, the present invention can be arranged in the finishing procedure with the continuous annealing units, replacing the functionalities of the original skin pass process, that is, the method of impacting the strip surface according to the present invention is utilized to improve the mechanical properties of the strip and control the surface roughness thereof, as shown in FIG. 9.

The technical solution of the steel sheet surface treatment device is as follows:

a steel sheet surface treatment device, wherein, it at least comprises one strip surface treatment unit 1 configured with a high pressure spraying device 1-1 or a centrifugal ejecting device 1-2, a strip surface rinsing unit 2 at the downstream of the strip surface treatment unit, a strip surface dry unit 3 at the downstream of the rinsing unit 2, a abrasive supplying device 4 and an abrasive recycling device 5.

Refer to FIGS. 3 to 9 wherein the devices of the present invention are applied onto the actual production lines.

The steel sheet surface treatment device according to the present invention, wherein the medium for impacting the strip surfaces is a mixture of solid particles and water, which has a mixture ratio of 10~95%, preferable 10~30%, and the solid abrasives can be iron sand, steel shots, cut wire shots, etc., and the particle sizes of the solid particles are between 20 and 100 meshes, preferably between 60 and 80 meshes.

The steel sheet surface treatment device according to the present invention, wherein the strip surface treatment unit 1 is provided with a plurality of groups of high pressure spraying devices 1-1 or centrifugal ejecting devices 1-2 along the width direction of the steel sheet, wherein 5~30 groups of high pressure spraying devices 1-1 are arranged along the width direction of the steel sheet, and each group of high pressure spraying devices 1-1 may cover 50~100 mm of a width of the strip which is 700~1400 mm.

2~8 rows of high pressure spraying devices 1-1 may be arranged along the running direction of the strip. For the centrifugal ejecting devices 1-2, 1~2 groups of the centrifugal ejecting devices 1-2 are arranged along the width of the steel sheet, and cover the spraying of the whole width of the steel sheet by adjusting the ejecting angle. Similarly, 2~8 rows of centrifugal ejecting devices 1-2 are also arranged along the running direction of the strip.

The steel sheet surface treatment device according to the present invention, wherein the present invention may be arranged in separate degreasing units.

Thus, the devices for pre-cleaning, brush washing, electrolytic cleaning, rinsing in the original units, may be replaced, as shown in FIG. 3.

Further, the steel sheet surface treatment device according to the present invention, wherein the device may be arranged before the annealing furnace and the entry loop of the continuous annealing units.

Accordingly, the devices for alkaline cleaning, brush washing, electrolytic cleaning, hot water rinsing in the traditional continuous annealing process, may be replaced, as shown in FIG. 4.

Further, the steel sheet surface treatment device according to the present invention, wherein the device may be arranged before the annealing furnace of the hot dip galvanizing units.

Accordingly, the rinsing process in the traditional hot dip galvanizing process may be replaced, as shown in FIG. 5.

Further, the steel sheet surface treatment device according to the present invention, wherein the device may be arranged before the electrogalvanizing sink after the entry loop of the electrogalvanizing units.

Accordingly, the processes such as degreasing, pickling in the traditional electrogalvanizing process may be replaced, as shown in FIG. 6.

Further, the steel sheet surface treatment device according to the present invention, wherein the present invention may be arranged at the downstream of the skin-pass units.

When the surface roughness of the skin-passed strip cannot meet the requirement of the customers, it acts as a roughness controlling process to control the surface roughness of the steel sheet precisely, which is especially suitable for the case in which the strip is of high strength and the requirements on the surface roughness by customers cannot be met by the skin pass process, as shown in FIG. 7.

The steel sheet surface treatment device according to the present invention, wherein the device may be arranged at the downstream of the skin pass process of the finishing procedure with the continuous annealing units and the skin pass units.

Thus, the surface roughness of the strip is controlled precisely. The continuous annealing units comprise processes such as hot dip galvanizing, electrogalvanizing, continuous annealing, as shown in FIG. 8.

The steel sheet surface treatment device according to the present invention, wherein the device may be arranged in the finishing procedure with the continuous annealing units.

Thus, the function of the original skin pass process may be replaced, that is, the method of impacting the strip surface according to the present invention is utilized to improve the mechanical properties of the strip and control the surface roughness thereof, as shown in FIG. 9.

The advantages of the present invention over the prior art include the following aspects:

1) in the present invention, the surface roughness of the strip depends upon the factors like the particle sizes of the abrasive particles sprayed onto the strip surface, the spraying distance, the spraying pressure and the like, and these related parameters may be controlled flexibly as the demand of the customers on the roughness, so as to control the surface roughness of the strip online. Especially for the strip of high strength, the method in the present invention may solve the problem in the traditional manufacturing process that the strip roughness is difficult to meet the requirements of the customers owing to the limitations on the factors such as the rolling and skin pass processes, the materials of the rollers, etc.;

2) in the traditional process, the dirty matters like grease, scales remaining on the strip surfaces have to be cleared thoroughly before annealing the strip, so as to satisfy the need of the surface quality thereof. Therefore, there are provided with different lengths of strip surface pre-treatment sections before the strip is subjected to annealing, and this operational mode may generate a large amount of unrecyclable waste alkali, and large energy consumption occurs. In the method of the present invention, the mixed abrasives are sprayed onto the strip surface to clear away the foreign materials thereon like grease, oxidized scales, etc., thereby completely or partially replacing the pre-treatment processes in the traditional process, reducing the discharging amount of the industrial waste alkali, reducing the length of procedure sections of the equipments and decreasing the energy consumption;

3) due to that the surfaces of the strip entering the strip pre-treatment section, present a variety of conditions, for example the bonding extents between the strip surface and the foreign material thereon, and the specific contents of the foreign materials are different, event some strip steels has to be placed for a long time before entering the surface treatment process due to the processing style, which results in that the foreign materials on the strip surface cannot be cleared away thoroughly when the traditional process is used to manufacture the strip. In the present invention, the foreign materials on the strip surfaces can be cleared by a physical way of spraying solid mixed particles thereto, which can ensure that no foreign material remains on the surfaces of the strip, and ensure the surface quality;

4) in the present invention the mechanical properties of the strip are adjusted by the energy and impacting speed of the slurry impacting onto the strip surface, free from the limitation of the equipment capacity of the pressing down system of the skin-pass mill and the strength of the strip, thereby solving the problems of the incapacity of the traditional skin pass process, and flexibly improving the mechanical properties of the strips according to the distinct usages of the strip.

5) in the present invention, the mechanical properties of the strip are adjusted by impacting the strip surface with the mixture of solid abrasives and water, which may replace the skin pass procedure, and the whole process cost is substantially reduced.

6) the present invention may be provided in the continuous hot dip galvanizing production line, the continuous electrogalvanizing production line, the continuous annealing production line, and the continuous degreasing procedure, in order to pre-treating the surface of the strip entering the above-mentioned processes, and also provided in the finishing procedures of the above-mentioned processes, completely or partially replacing the original skin pass process and flexibly configuring in view of the demands of products and processes;

The solid particles may be recycled, hence the cost thereof is low.

The medium for impacting the strip surfaces in the present invention is the mixture of solid particles and water, without particular requirements on the surface conditions of the strip to be treated, thereby presenting simple operation and low maintenance cost.

Figure 1:
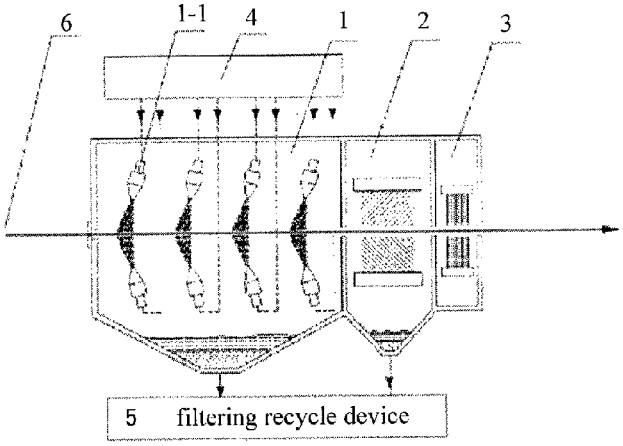
FIG. 1 is a schematic view 1 of a strip surface treatment device.

In the drawings, the reference numeral 1 indicates a strip surface treatment unit, 1-1 a high pressure spray device, 1-2 a centrifugal ejecting device, 2 a strip surface washing unit, 3 a strip surface dry unit, 4 a slurry supplying unit, 5 an abrasive recycling unit, 6 a strip, 7 an uncoiler, 8 a welding machine, 9 a coiler, 11 an annealing exit loop, 10 an entry loop, 12 an annealing furnace, 13 a skin-pass mill, 14 an annealing units, 15 a zinc pot.

DETAILED DESCRIPTION

Embodiment 1

Figure 3:
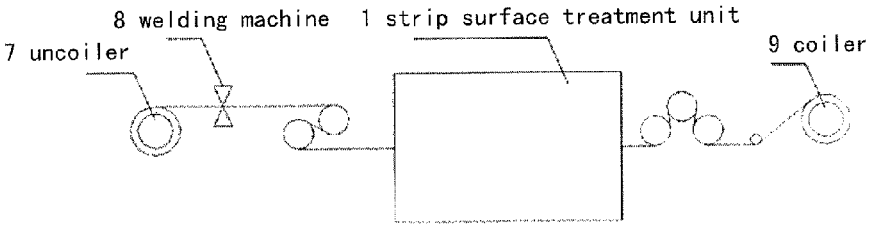
FIG. 3 is a schematic view of a strip surface pre-treatment process of Embodiment 1.

Taking the process wherein the separate degreasing units are provided with a strip surface treatment device in the present invention as an example, and referring to FIG. 3, the detailed embodiment is as follows:

The strip in this embodiment is the cold rolled one with a width of 700~1300 mm and a thickness of 0.2~3 mm. At this moment, a variety of dirty matters generated during the rolling process remain on the strip surfaces, including rolling oil and oil dreg therein, iron powder generated in the rolling process, accumulating dust, weld slag generated in welding, or the like. The surface roughness of the strip after cold rolling, is 0.7~0.8 μm, while the required surface roughness by the customer is 1.5 μm.

The strip uncoiled by the uncoiler 7 is welded by the welding machine 8, then enters the steel sheet surface treatment device 1 via the tension rollers, which could be configured with a high pressure spray device 1-1 or a centrifugal ejecting device 1-2 shown as FIG. 1. If the high pressure spray device 1-1 is configured, steel shots with a particle size of 80~100 meshes are used as the solid abrasive, and the mixture ratio of the steel shots and water is controlled at 50%, and the speed at which the mixture of the steel shots and water impacts on the strip surfaces is 70~90 m/min. If the centrifugal ejecting device 1-2 is configured in the steel sheet surface treatment device 1, steel shots with a particle size of 80~100 meshes are used as the solid abrasive, and the mixture ratio of the steel shots and water is 70%, and the speed at which the mixture of the steel shots and water impacts on the strip surfaces, is 70~90 m/min. The dirty matters on the strip surface treated in this way are impacted by the solid abrasives and water, and leave the strip surface with the suspension liquid, such that the objective of clearing away the dirty matters is achieved. Besides, due to that the solid particles impacting on the strip surfaces, have a certain energy and velocity, and the size of the solid particles is larger than that of the strip, tiny disordering dents are formed on the surfaces thereof, so as to achieve the objective of controlling the surface roughness of the strip. The surface roughness of the strip treated in such a way can reach 1.4~1.5 μm. The strip treated by the steel sheet surface treatment device 1, enters the strip surface washing unit 2, wherein pure water with a pressure of 20 MPa rinses the surfaces of the strip such that the solid abrasives are separated therefrom and enter the lower portion of the steel sheet surface treatment device 1 before being recycled by the filtering recycle device 5. No solid particle exists on the surface of the strip treated in such a way, which is then dried by hot wind of 100° C. in the strip surface dry unit 3, and coiled by the coiler 9.

Figure 10:
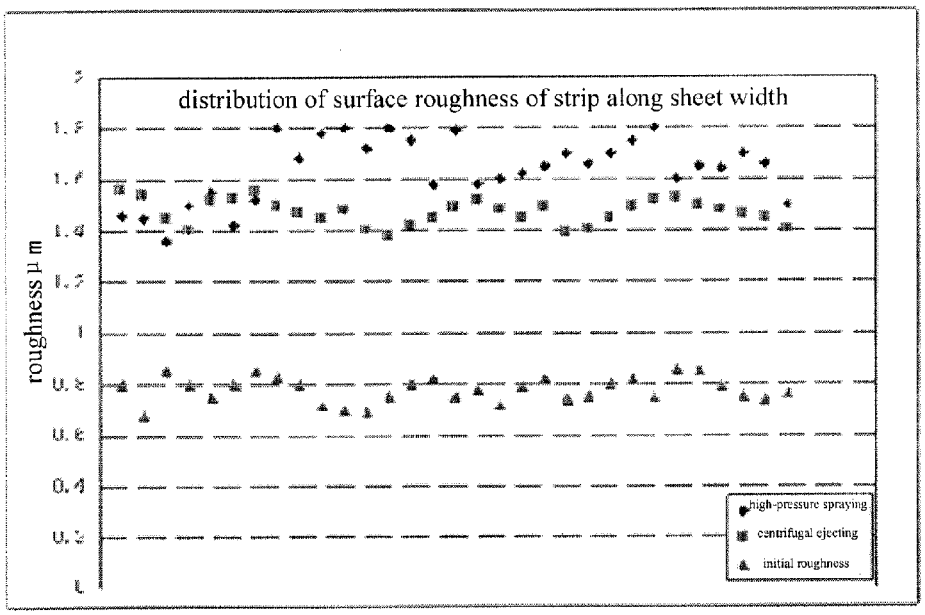
FIG. 10 shows the distribution of the surface roughness of the strips under Embodiment 1.

The distribution of the surface roughness of the strip treated in this way along the width of the sheet is shown as FIG. 10.

Embodiment 2

Figure 4:
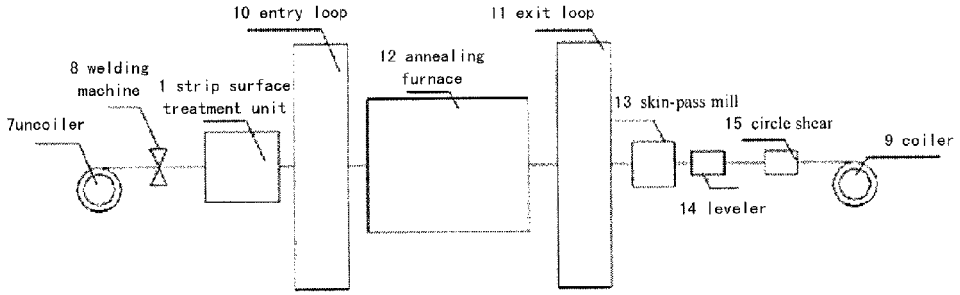
FIG. 4 is a schematic view of a strip surface pre-treatment process of Embodiment 2.

Taking the process wherein the continuous annealing units are provided with the strip surface treatment device in the present invention as an example, and referring to FIG. 4, the detailed embodiment is as follows:

The strip in this embodiment is the cold rolled one with a width of 700~1300 mm and a thickness of 0.2~3 mm. At this moment, a variety of dirty matters generated during the rolling process remains on the strip surfaces, including rolling oil and oil dreg therein, iron powder generated in the rolling process, accumulating dust, weld slag generated in welding, or the like. The surface roughness of the strip after cold rolling, is 0.7~0.8 μm, while the required surface roughness by the customer is 1.5 μm.

The strip uncoiled by the uncoiler 7 is welded by the welding machine 8, then enters the steel sheet surface treatment device 1, wherein the treatment is the same as that in Embodiment 1. The strip treated in such a way enters the entry loop 10, before it is annealed by the annealing furnace 12. Then the strip is flattened, leveled, and finally coiled by the coiler, thereby finishing the whole annealing process.

Embodiment 3

Figure 5:
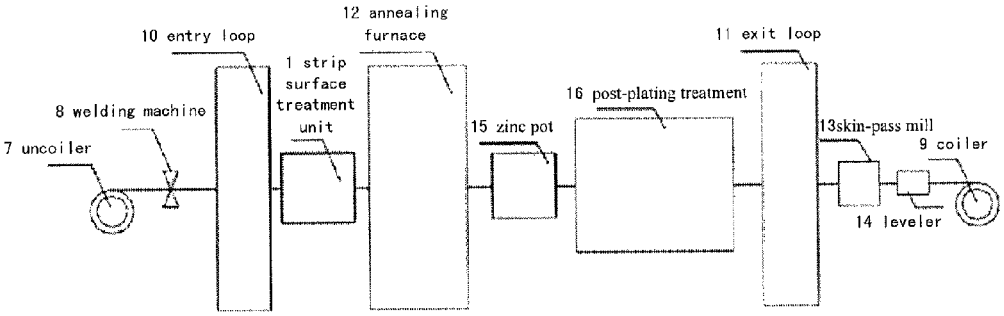
FIG. 5 is a schematic view of a strip surface pre-treatment process of Embodiment 3.
Figure 6:
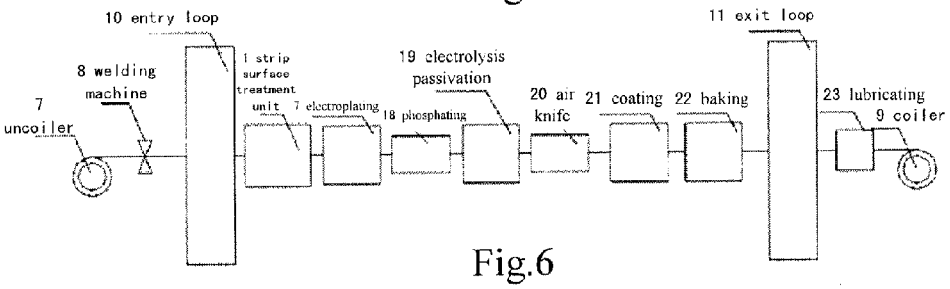
FIG. 6 is a schematic view of a strip surface pre-treatment process of Embodiment 4.

Taking the process wherein the continuous hot dip galvanizing units are provided with the strip surface treatment device in the present invention as an example, and referring to FIG. 5, the detailed embodiment is as follows:

The strip uncoiled by the uncoiler 7 is welded by the welding machine 8, then enters the entry loop 10, and subsequently enters the steel sheet surface treatment device 1, wherein the treatment is similar to that in Embodiment 1. The strip treated by the steel sheet surface treatment device 1 is annealed by the annealing furnace 12 before it is hot dip galvanized, thereby finishing the whole hot dip galvanizing process.

Embodiment 4

Taking the process wherein the continuous electrogalvanizing units are provided with the strip surface treatment device in the present invention as an example, and referring to FIG. 5, the detailed embodiment is as follows:

The strips uncoiled by the uncoiler 7 are welded by the welding machine 8, then enter the entry loop 10, and subsequently enter the steel sheet surface treatment device 1, wherein the treatment is similar to that in Embodiment 1. The strip treated by the steel sheet surface treatment device 1 is subsequently electroplated, phosphated, coated, and the like, thereby finishing the whole electrogalvanizing process.

Embodiment 5

Taking the process layout of the method of the present invention in FIG. 7 which is added after the skin pass procedure as an example, and referring to FIGS. 1 and 2, the detailed embodiment is as follows:

In this embodiment, a cold rolled steel sheet with a thickness of 0.3~0.8 mm and a width of 800~1200 mm, is used, and when it is flattened, the elongation rate thereof is 0.8%. The skin-pass mill is provided with smooth rollers, and the required roughness of the strip is 1.5 μm.

Figure 7:
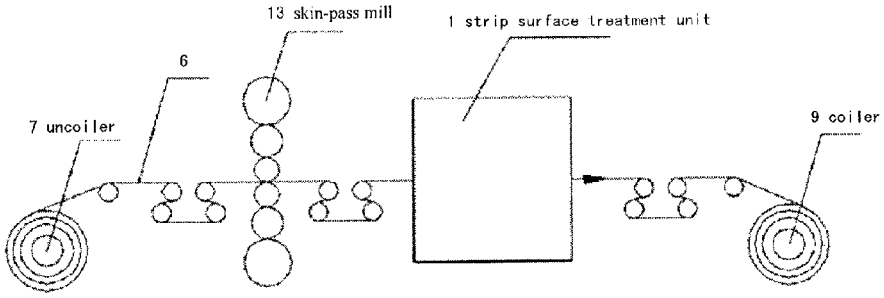
FIG. 7 is a schematic view of a strip surface pre-treatment process of Embodiment 5.

Taking the process layout in FIG. 7 as an example, the strip 6 uncoiled by the uncoiler 7 passes through the tension rollers, then enters the skin-pass mill 13. The skin-pass mill flattens the steel sheet by an elongation rate of 0.8%, so as to improve the mechanical properties and the shape of the strips. The flattened strip passes though the tension rollers, then enters the strip surface treatment unit 1 which is configured with a abrasive supplying device 4. In the device 4, steel shots with a particle size of 60 meshes are used as the solid abrasives, and the mixture ratio of the solid abrasives and water is 70%. The abrasive supplying device 4 supply the slurry with the above-mentioned mixture ratio to the high pressure spray device 1-1, which provides energy to the slurry, so as to impact the slurry onto the strip surfaces at a speed of 120 m/s. Owing to that the medium impacting the strip surfaces are the mixtures of solid particles and water, a small amount of slurry may remain thereon, and most of slurry will stack beneath the tapered sink. The strip impacted by the slurry enters the strip rinsing unit 2, which uses pure water of 20 MPa to rinse the lower and upper surfaces of the strips, to clear the residual solid particles thereon. Subsequent to it, the strip enters the dry device 3, which dries the steel sheet with high temperature gas of a temperature 100° C., so as to meet the requirements of the following procedures like coiling. Then the strip passes through the tension rollers and is coiled by the coiler 9.

If the steel sheet surface treatment device 1 uses the centrifugal ejecting device 1-2, the mixture ratio of solid particles and water is 60%, and the centrifugal ejecting device 1-2 provides impact energy to the slurry by means of blades, with the impact speed of 120 m/s on the strip surface and the impact density of 2 kg/m$^2$ per unit area. Other stages are similar to the above-mentioned ones.

Embodiment 6

Figure 8:
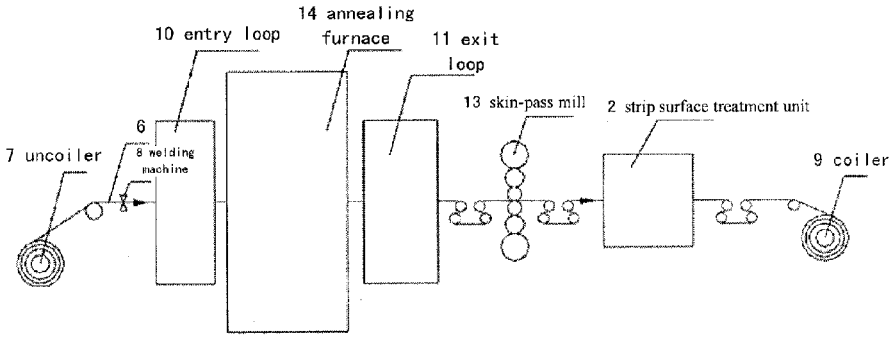
FIG. 8 is a schematic view of a strip surface pre-treatment process of Embodiment 6.

Taking the process layout of the method of the present invention in FIG. 8 which is added after the skin pass procedure of the continuous annealing process as an example, and referring to FIGS. 1 and 2, the detailed embodiment is as follows:

In this embodiment, a clod rolled steel sheet with a thickness of 0.3~0.8 mm and a width of 800~1200 mm, is used, and when it is flattened, the elongation rate thereof is 0.6%. The skin-pass mill is provided with smooth rollers, and the required roughness of the strip is 1.2 μm.

The strip 6 uncoiled by the uncoiler 7 enters the steel sheet cutting and welding units 8, then passes through the entry loop 10 and enters the continuous annealing units 14. There is yield platform in the mechanical properties of the strips treated in such a way, which has an effect on the shaping of strips. The annealed strip passes through the annealing exit loop and enters the skin-pass mill units 13. Tension devices are provided both at the upstream and downstream of the skin-pass mill units. During the skin pass process, the steel sheet is flattened by an elongation rate of 0.6%, so as to eliminate the yield platform existing in the annealed strips and improve the shape of the strip. The flattened strip enters the strip surface treatment unit 1 which is configured with a high pressure spraying device 1-1 as shown in FIG. 1. In the device 1-1, steel shots with a particle size of 80 meshes are used as the abrasives, and the mixture ratio of the solid abrasives and water is 60%. The slurry impacts onto the strip surfaces at a speed of 100 m/s; if the steel sheet surface treatment device 1 is configured with the centrifugal ejecting device 1-2 as shown in FIG. 2. In the device 1-2, steel shots with a particle size of 80 meshes are used as the solid abrasives, and the mixture ratio of solid particles and water is 50%, and the slurry impacts onto the strip surface at a speed of 100 m/s. The strip treated in such a way enters the rinsing device 2 and the dry device 3 in which the process is the same as that of Embodiment 5, and passes through the tension roller units and enters the leveling unit to further improve the shape of the strip, then is coiled by the coiler 9.

Embodiment 7

Figure 9:
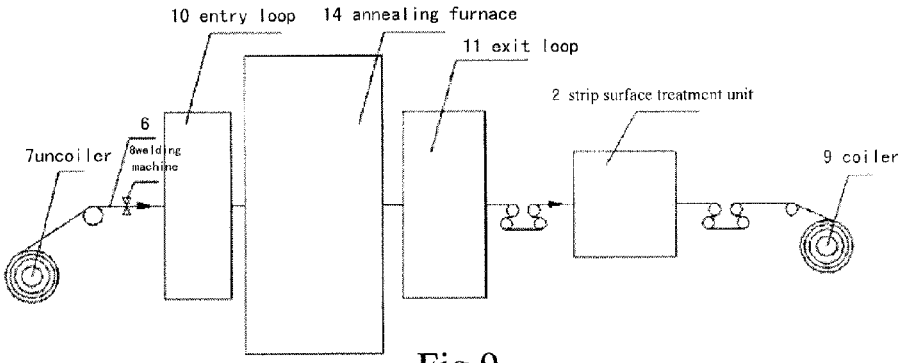
FIG. 9 is a schematic view of a strip surface pre-treatment process of Embodiment 7.

Taking the process layout of the method of the present invention in FIG. 9 which is added after the skin pass procedure of the continuous annealing process as an example, and referring to FIGS. 1 and 2, the detailed embodiment is as follows:

In this embodiment, a clod rolled steel sheet with a thickness of 0.3~0.8 mm and a width of 800~1200 mm, is used, and the required roughness of the strip is 1.2 μm.

The strip 6 uncoiled by the uncoiler 7 enters the strip cutting and welding units 8, then passes through the entry loop 10 and enters the annealing units 14. Subsequently, the annealed strip passes through the annealing exit loop 11 and directly enters the strip surface treatment unit 1. The strip surface treatment unit is provided with tension roller units both at the upstream and downstream thereof and with a plurality of groups of high pressure spraying device 1-1. After the strip enters the device 1-1, the groups 1, 2 of the devices 1-1 sprays the surface of the strip first, wherein the particle size of the impacting abrasives is 30 meshes and the mixture ratio of the slurry is 70%, and the speed of the abrasives impacting onto the strip surfaces is 150 m/s. With the aforementioned treatment, the mechanical properties of the strip can change and the yield platform existing in the annealed strip may vanish. In such a way, the strip enters the groups 3, 4 of high pressure spraying device, wherein the particle size of the impacting abrasives is 80 meshes and the mixture ratio of the slurry is 60%, and the speed of the abrasives impacting onto the strip surfaces is 100 m/s. The surface roughness of the strip treated in the above way has reached the requirement by the customer, and the subsequent strip enters the surface rinsing device 2, which uses pure water of 20 Mpa to wash the upper and lower surfaces of the strip. After that, the strip enters the dry unit 3 that dries the strip surface with pressed air with a temperature of 100° C., so as to satisfy the requirement of coiling process and the like.

Figure 2:
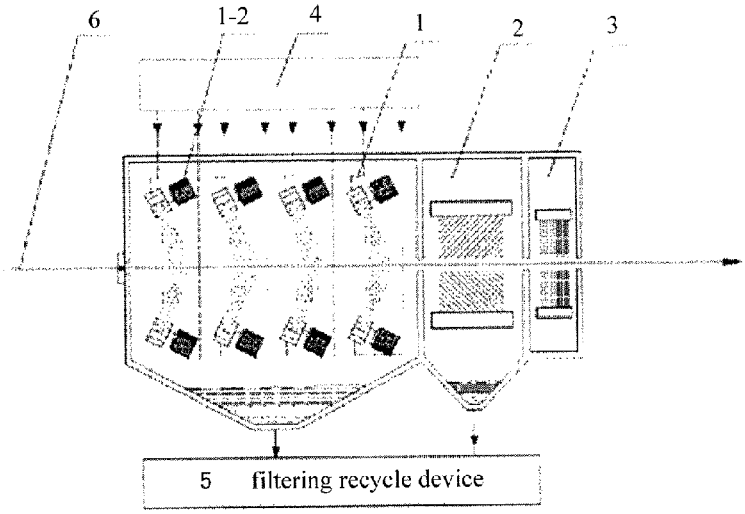
FIG. 2 is a schematic view 2 of a strip surface treatment device.

If the steel sheet surface treatment device 1 is configured with the centrifugal ejecting device 1-2 as shown in FIG. 2, the embodiment is similar to the above-mentioned, but the impact speed of the slurry sprayed by the groups 1, 2 of the centrifugal ejecting device 1-2 is 150 m/s, and the abrasive particle sizes of the solid particles are 30 meshes, and the mixture ratio of solid particles and water is 60%; while the impact speed of the abrasives sprayed by the groups 3, 4 of the centrifugal ejecting device is 100 m/s, and the abrasive particle sizes of the solid particles are 80 meshes, and the mixture ratio of solid particles and water is 60%.

Figure 11:
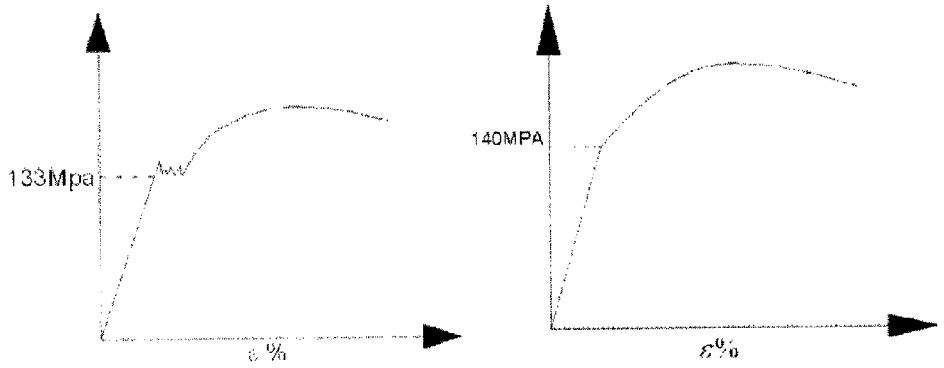
FIG. 11 is a comparative view showing the variation of the mechanical properties of the strips under Embodiment 7.

The comparison between the mechanical properties of the strip treated in this way and the strip prior to treating, is shown in FIG. 11.

According to the present invention, by the method wherein solid mixed abrasives are used to impact onto the strip surface, the surface roughness can be online controlled flexibly, and the dirty matters such as the grease, scales residual on the strip surface can be cleared away. Additionally, it can replace the function of the skin pass procedure completely or partially. Due to the technology in this patent is mature and implemented easily, the spread application is available. Besides, this patent is capable of solving the problem well that the surface roughness cannot be improved because of the incapability of the equipments, and is highly valuable in product extension and the improvement of the product quality. Accordingly the present invention has a wide potential in applying into the filed of steel sheet surface treatment.

What is claimed is:

1. A method of steel sheet surface treatment, the method comprising:

spraying at least a portion of a steel sheet surface with a strip surface treatment unit (1) configured with at least one of a high pressure spraying device (1-1) or a centrifugal ejecting device (1-2), wherein either or both of the high pressure spraying device (1-1) and the centrifugal ejecting device (1-2) are arranged to spray a slurry of solid abrasives and water onto at least a portion of the strip surface;

rinsing the sprayed steel sheet surface in a strip surface rinsing unit (2);

drying the rinsed steel sheet surface in a strip surface dry unit (3);

wherein the slurry is provided to the strip surface treatment unit (1) by a slurry supplying unit (4), and the slurry supplying unit (4) supplies slurry with abrasives of different particle sizes and different mixture ratios to each high pressure spraying devices (1-1) or centrifugal ejecting devices (1-2); and recycling at least a portion of the solid abrasives from the slurry in an abrasive recycling unit (5).

2. The method according to claim 1, wherein the slurry of solid abrasives and water comprises a mixture ratio of 10~95%, and wherein the solid abrasives are selected from the group consisting of iron sand, steel shots, and cut wire shots, and the particle sizes of the solid abrasives are between about 20 and about 100 meshes.

3. The method according to claim 1, wherein the strip surface treatment unit (1) further comprises:

a plurality of high pressure spraying devices (1-1) positioned along the width of the steel sheet, wherein the high pressure spraying devices (1-1) cover at least 50~100 mm of the width of the strip; and 2~8 rows of high pressure spraying devices (1-1) provided along the running direction of the strip.

4. The method according to claim 1, wherein surface roughness of the strip is controlled between 0.5 μm and 5 μm.

5. The method according to claim 1, wherein the strip surface treatment unit (2) rinses the strip surfaces with water at a pressure 5~30 MPa, and the strip surface dry unit (3) dries the strip surfaces with hot wind.

6. The method according to claim 1, wherein the speed of the solid abrasives and water impacting onto the strip surface is in the range of 30 m/s~300 m/s.

7. A steel sheet surface treatment device comprising:

at least one strip surface treatment unit (1) configured with at least one high pressure spraying device (1-1) or centrifugal ejecting device (1-2) to spray a slurry of solid abrasives and water, and wherein the centrifugal ejecting devices (1-2) sprays onto the central portion of the strip and wherein the high pressure spraying device (1-1) sprays onto the edge portions of the strip;

a strip surface rinsing unit (2) positioned downstream of the strip surface treatment unit device;

a strip surface dry unit (3) positioned downstream of the rinsing unit (2);

an abrasive supplying device (4); and an abrasive recycling device (5).

8. The device according to claim 7, wherein the slurry comprises a mixture of solid abrasives and water in a ratio of 10~95%, and the solid abrasives are selected from the group consisting of iron sand, steel shots, and cut wire shots and the particle sizes of the solid abrasives are between 20 and 100 meshes.

9. The device according to claim 7, wherein the strip surface treatment unit (1) comprises:

a plurality of high pressure spraying devices (1-1) or centrifugal ejecting devices (1-2) positioned along the width direction of the steel sheet, wherein each spraying device (1-1) covers 50~100 mm of a width of a strip; and 2~8 rows of high pressure spraying devices (1-1) arranged along the running direction of the strip.

* * * * *